US005830020A

United States Patent [19]

Snyder

[11] Patent Number: 5,830,020

[45] Date of Patent: Nov. 3, 1998

[54] BICYCLE FLOATATION AND TRANSPORTATION DEVICE AND METHOD

[76] Inventor: John R. Snyder, 436 Saxonwood Rd., Altoona, Wis. 54720

[21] Appl. No.: 768,950

[22] Filed: Dec. 18, 1996

[51] Int. Cl.[6] ..... B63H 21/175

[52] U.S. Cl. ..... 440/12; 440/29; 440/31

[58] Field of Search ..... 440/12, 21, 26, 440/29, 30, 31; 441/65

[56] References Cited

U.S. PATENT DOCUMENTS

| | | | |
|---|---|---|---|
| 547,422 | 10/1895 | Dean . | |
| 3,082,443 | 3/1963 | Kimura | 441/65 |
| 3,640,239 | 2/1972 | Petroskey | 115/27 |
| 3,953,904 | 5/1976 | Fry | 9/1 R |
| 4,789,365 | 12/1988 | Jones | 440/21 |
| 4,936,801 | 6/1990 | Herrit | 440/12 |
| 5,011,441 | 4/1991 | Foley et al. | 440/26 |
| 5,224,886 | 7/1993 | Cunningham | 440/12 |
| 5,248,271 | 9/1993 | Chu | 440/12 |
| 5,415,574 | 5/1995 | Siviero | 440/12 |
| 5,443,405 | 8/1995 | Zeyger | 440/12 |

FOREIGN PATENT DOCUMENTS

| | | | |
|---|---|---|---|
| 860153 | 12/1952 | Germany | 440/12 |

*Primary Examiner*—Sherman Basinger
*Attorney, Agent, or Firm*—Anthony J. Bourget

[57] ABSTRACT

This device is a raft which when attached to a standard bicycle may be steered and propelled through water by riding the bicycle in the usual fashion. The raft consists of two sections that can be folded for easy storage and transportability. These two sections unfold and are plugged together to form the raft. The bicycle is attached to the raft by adjustable tie-down straps. The drive mechanism incorporates both forward and reverse drive operated by a remote hand lever. Propulsion is accomplished by a friction wheel engaging the rear wheel of the bicycle with power transmission and translation through a gear assembly to the drive shaft and propeller. The front steering unit and rear drive unit are designed to swivel up out of the way if hit by an underwater obstacle.

29 Claims, 16 Drawing Sheets

BICYCLE FLOATATION AND TRANSPORTATION DEVICE AND METHOD

FIELD OF THE INVENTION

The present invention relates to bicycle floatation devices, and particularly to devices that are effectively navigable, and that are foldable and detachable for ease of transport and storage.

BACKGROUND OF THE INVENTION

The concept of attaching a bicycle to a buoyant raft for propulsion through the water is not new. There are several patents involving a flotation apparatus for a bicycle including; U.S. Pat. Nos. 3,640,239; 4,789,365; 4,936,801; 5,224,886; 5,415,574 and 5,443,405. Most of these designs are bulky and more difficult to transport. Assembly is often laborious requiring tools and modification of the bicycle. Some of these past designs are also unstable and inefficient or clumsy to operate.

The goal of the present invention is to produce a device that improves on the previous designs in ease and functionality of use, transportability, and cost of production. Manufacture of this device should be relatively easy since most parts are molded plastic and slide together without the need for welding or labor intensive fastening devices. The use of molded plastic parts and lower labor requirements make this relatively inexpensive to mass produce. It was also designed for ease of use with few pieces that plug together and with tie-down straps to rapidly attach the bicycle. Safety was another consideration with the enclosed gear housing and the large buoyant raft for stability. In addition, no previous designs had reverse capability or a mechanism for damage control. Storage and transportability are one of the most attractive features of this design since the apparatus separates into two sections, each of which can be folded.

This device is unique in that none of the aforementioned patents include any of the following features: remote hand lever for reverse gear; a means of damage control of the propeller and rudder; a method of rapidly attaching a bicycle without the use of tools; and the ability to detach and fold the unit into two symmetric sections allowing better transportability and easy storage.

SUMMARY OF THE INVENTION

This invention is composed of a front and rear section that are detachable. The front section contains the steering unit and the rear section has the drive unit. Both sections are hinged and fold approximately in half. The two sections are easily joined by plugging them together. When a bicycle is attached, the steering unit will lie directly under the front wheel of the bicycle and the drive unit will be under the rear wheel of the bicycle.

This device easily attaches to almost any size or style of bicycle with nylon tie-down straps that hook under the seat and under the handlebars of the bicycle. The straps are rapidly adjusted (in the usual fashion) by tugging on the loose end of the strap until taught. The straps are attached to corners or corner areas of the raft, and when taught will keep the bicycle in a fixed upright position and provide extra support in keeping the front and rear sections together.

Since the steering unit (rudder) is directly under the front wheel of the bicycle, the raft is maneuvered in the same fashion as the bicycle. Turning the handlebars to the right turns the raft to the right and visa-versa. The rudder is flexible and will fold if struck by an underwater obstacle preventing or at least minimizing damage that may otherwise occur.

The drive unit is located under the rear tire of the bike and power is transferred by a friction wheel. There are flanges on either side of the wheel keeping the rear tire of the bike from shifting laterally. A series of gears transfer and translate the power to the drive shaft. The drive shaft is centered so the force of propulsion is in line with the center of gravity. There is also a reverse gear operated by a remote hand lever connected by a thin cable to the drive unit. This feature allows for forward or reverse direction of the raft while pedaling the bicycle in the usual way. With reverse the raft may be backed away from a dock or other water-craft without dismounting. The drive unit like the steering unit is hinged so that if an underwater object is hit, the propeller (or rudder) will swing up minimizing damage to that unit. Both the drive and steering sections of the raft slide on tubing to adjust to most sizes of bicycles and to allow for precise weight distribution. The gears of the drive unit are enclosed for safety and to keep debris out of the gear mechanism.

DETAILED DESCRIPTION OF THE PREFERRED EMBODIMENT

Figure 1:
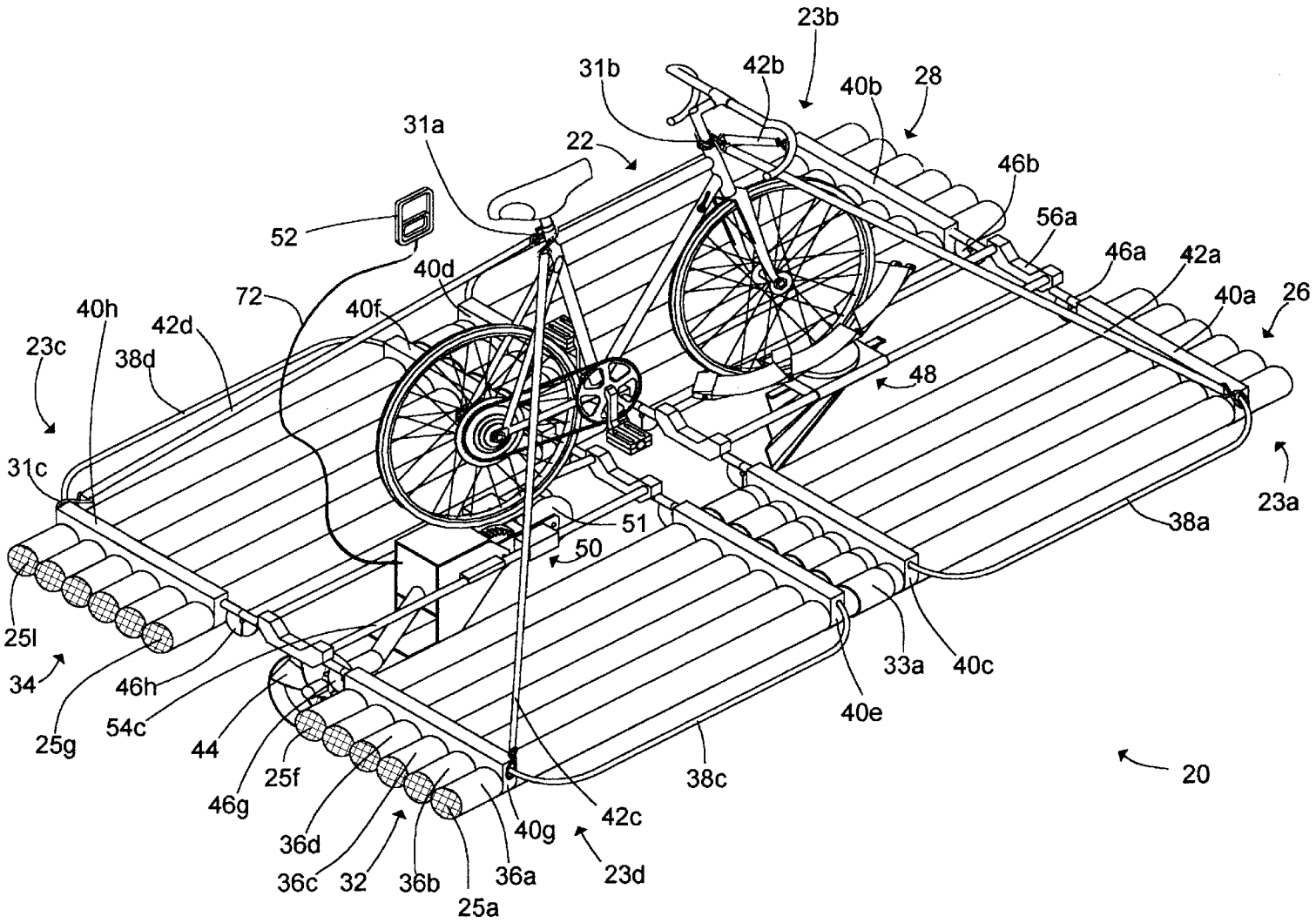
FIG. 1 is a perspective view of the completely assembled craft of the present invention and having an attached bicycle.

FIG. 1 demonstrates attachment of bicycle 22 to bike-boat 20 by use of nylon tie-down straps 42*a–d*. Straps 42*a–d* are adjustable to accommodate any size bicycle and attach with hooks 31*a–c* to the frame of the bicycle 22 under the bicycle seat and near the base of the bicycle handle bars. Straps 42*a–d* are then attached to bike-boat 20 near outer corners 23*a–d* with hooks 31. Attachment near or at outer corners 23*a–d* of bike-boat 20 provides the greatest stability of bicycle 22. A multiplicity of hooks 31 may be used to attach straps 42*a–d* to the bicycle as shown in FIG. 1. The rear wheel of the bicycle is supported by drive unit 50 and the front wheel is supported by steering unit 48. When straps 42*a–d* are adjusted, they securely hold bicycle 22 in place to prevent tipping. Straps 42*a–d* also provide force to keep hinges 46*a–h* in a fully opened position (see FIG. 14) and to secure front section 24 and rear section 30 from drifting apart. See FIG. 14. Bike-boat 20 is comprised of a multiplicity of PVC tubes or tubing 36*a–d*, each of which are held in place by connectors 40*a–h*. (It should be appreciated that tubing 36*a–d*, and connectors 40*a–h*, all shown in FIG. 1, are merely illustrative of the plurality of such items which may be incorporated into the apparatus—reference numerals "36" and "140" will be used hereinafter to refer to the plurality of each device). Connectors 40 also serve in attaching tubing 36 to the metal tubular frame 38*a–d*.

Figure 2:
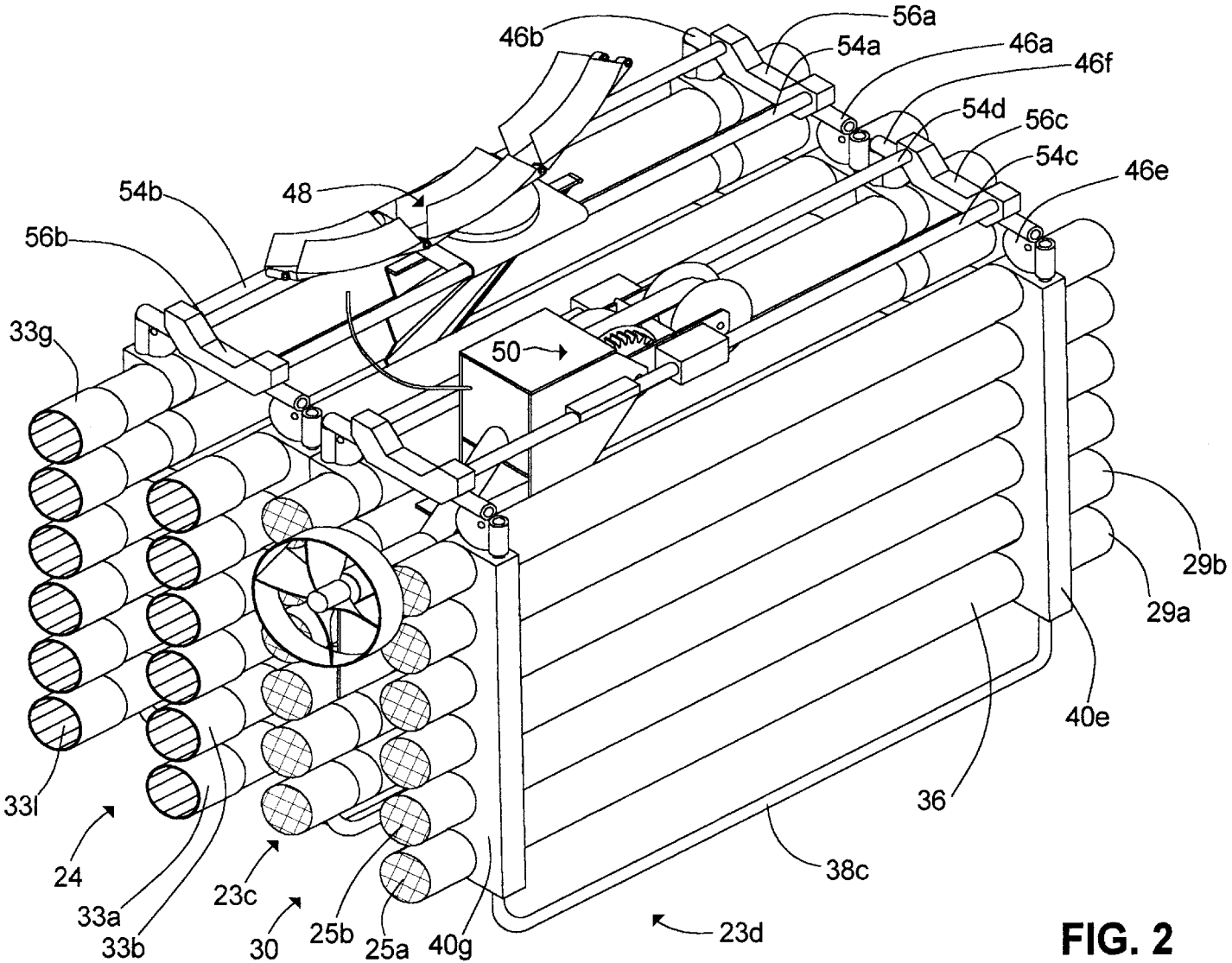
FIG. 2 is a perspective view of the disassembled craft of the present invention and where the folded front and rear sections are placed side-by-side.

FIG. 2 illustrates bike-boat 20 when it is disassembled. Hinges 46*a–h* fold so that bike-boat 20 fits in a compact space. Rear section 30 plugs into front section 24. Rear section 30 and front section 24 each comprise a plurality of standard PVC tubing 36. Tubing 36 contained in front section 24 comprises flared ends 33*a–l*. Tubing 36 contained in rear section 30 includes insert ends 29*a–l*. Each of the flared ends "33" are designed to receive corresponding insert ends "29". Accordingly, front end 24 receives rear end 30 so that front end 24 and rear end 30 are connected together. Typically, connection of rear end 30 and front end 24 is made when rear end 30 and front end 24 are unfolded so that apparatus shown in FIG. 1 is achieved.

Connectors 56*a–d* connect center posts 54*a–d* to frame 38*a–d*. Tubes 36 have caps 25*a–l* inserted into the non-flared ends forming a compartment to maintain buoyancy. Caps 25*a–l* may also be inserted at the flared ends 33 of tubes 36, but these are placed further inside the tube immediately before the position where the tube flares. (See FIG. 18). This maintains a water tight compartment in all tubes 36. Caps 25*a–l* could also be conical in the front of bike-boat 20 to further reduce water resistance. In addition, flared ends 33 of tubes 36 could be at the back of the rear section 30 making the raft portion of sections 24 and 30 identical (with the only difference being the drive unit 50 and the steering unit 48 attached to the rear section 30 and front section 24, respectively). In this way, multiple bike boats may be plugged together, if desired.

Figure 3:
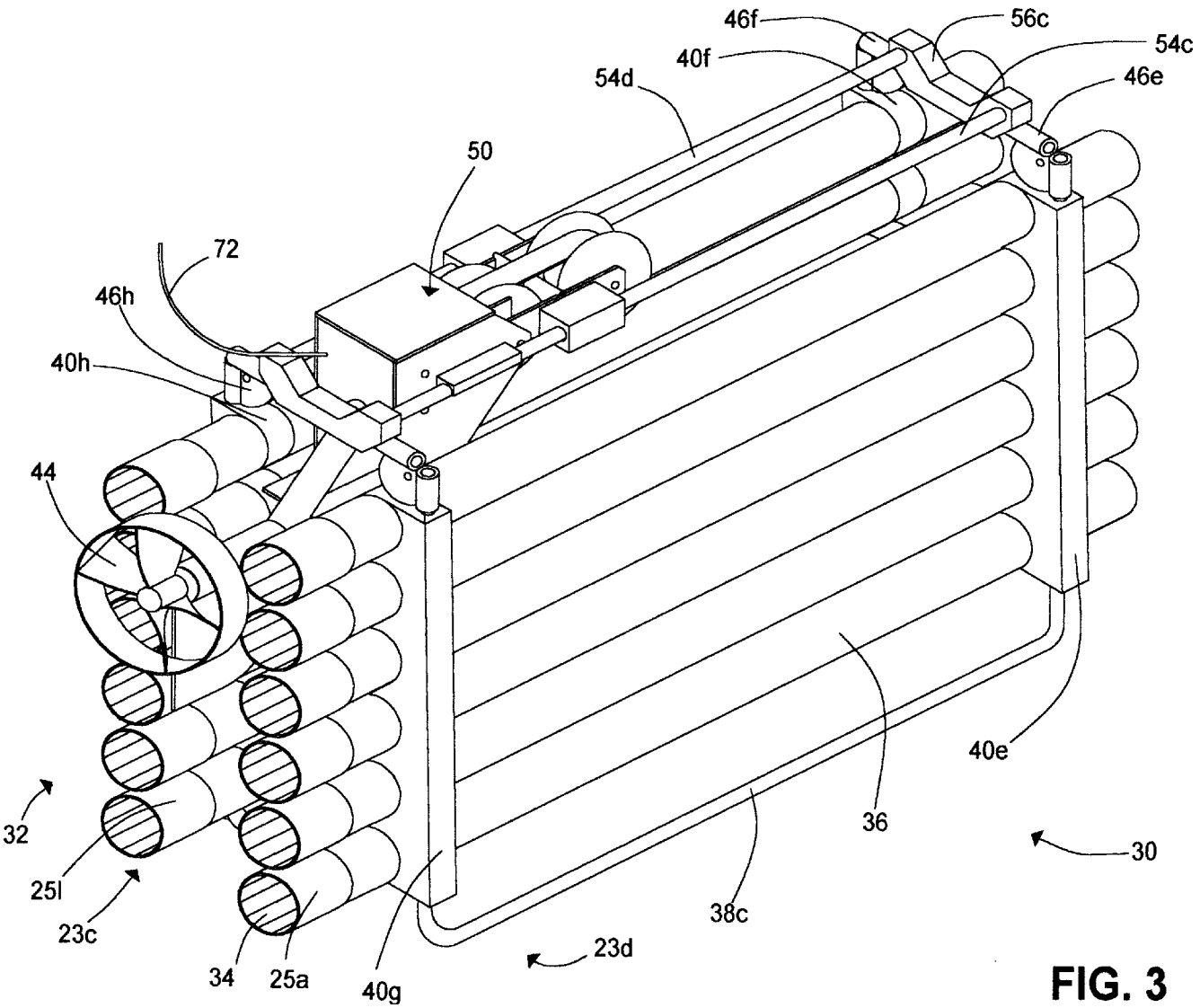
FIG. 3 is a perspective view of the folded rear (drive) unit.

FIG. 3 illustrates folded rear end 30 as it stands alone. Rear end 30 comprises left rear section 32 and right rear end section 34, both hingedly connected to drive unit 50. Left rear section 32 and right rear section 34 are both folded at hinges 46 at 90 degree angles.

Figure 4:
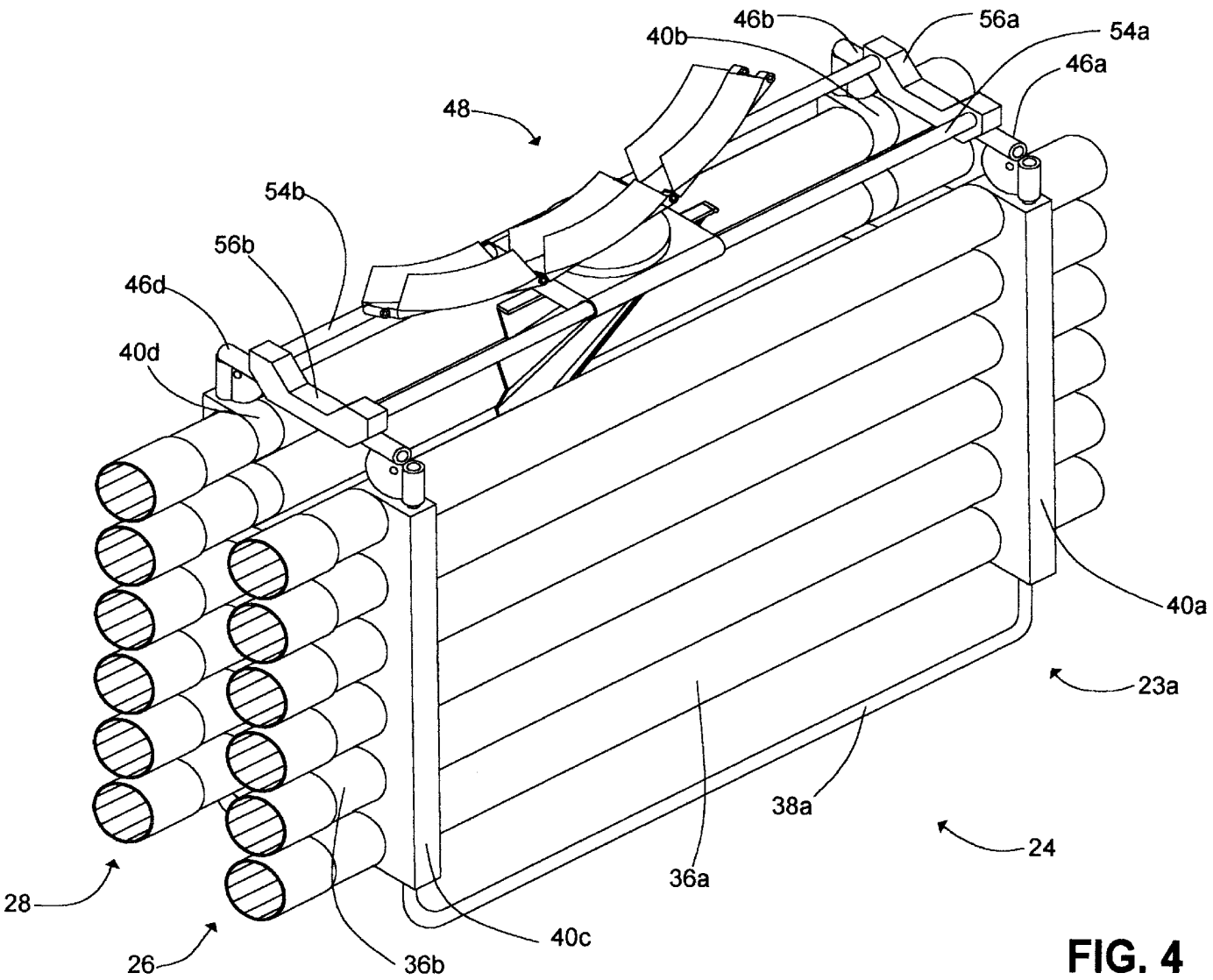
FIG. 4 is a perspective view of the folded front (steering) unit.

FIG. 4 illustrates folded front end 24 as it stands alone. Front end 24 comprises left front section 28 and right front section 26, both hingedly connected to steering unit 48. Left front section 28 and right front section 26 are both folded at hinges 46 at 90 degree angles.

Figure 5:
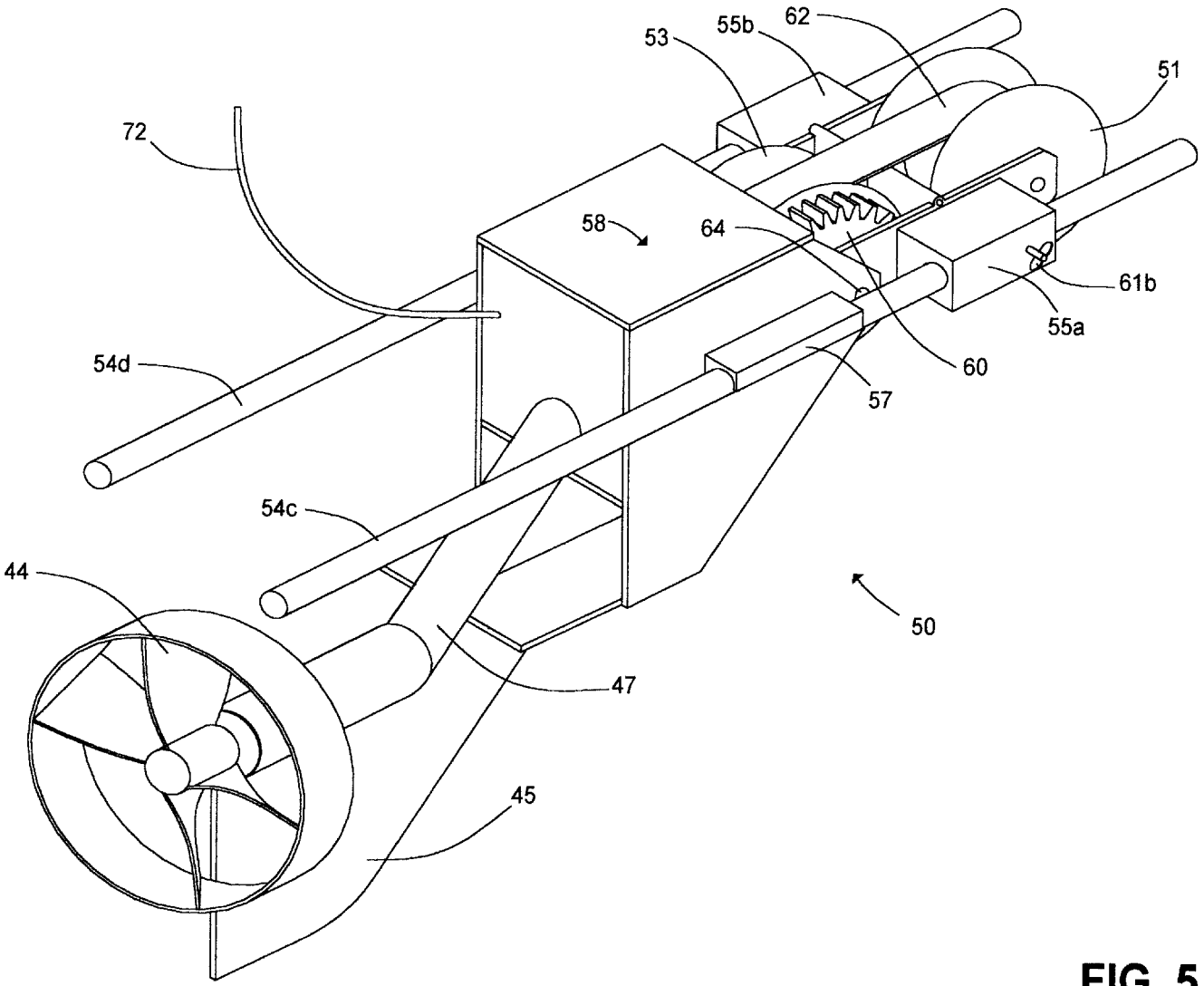
FIG. 5 is a perspective view of the drive unit.

FIG. 5 illustrates drive unit 50. The rear wheel of the bicycle (not shown) rests on belt 62 between flanged wheels 51 and 53. Belt 62 is optional, but may help improve traction especially when wet. Gear box 58 contains the drive and shifting mechanism. Drive shaft 84 and drive shaft housing 47 extend from the rear of gear box 58. Propeller 44 is attached to the end of the drive shaft 84. Propeller guard 45 protects propeller 44 in shallow water or if underwater obstacles are encountered. Drive unit 50 contains sliding mounting brackets 55*a–b* and finger brackets 57 which engage with center posts 54*c–c*. Sliding mounting brackets 55*a–b* completely encircle center posts 54*c* and 54*d* and support the majority of the weight of bicycle 22. Thumbscrew 61*b* fixes sliding mounting brackets 55 on center posts 54 so that adjustment can be made to accommodate different sized bicycles. Specifically, the positioning of drive unit 50 upon center posts 54 may be adjusted by unscrewing thumbscrew 61*b* and sliding the sliding mounting brackets 55 along center posts 54. When an operator obtains a desired position, thumbscrew 61 is tightened, thereby securing brackets 55 to center posts 54. An operator may wish to adjust the positioning of drive unit 50 to accommodate for various sizes of bicycles and to control the weight distribution of the bike-boat 20. Additional adjusting means may be used which may include notched center posts, push/pull buttons, pegs, or any other adjusting mechanism that allows the user to apply friction to secure drive unit 50 to a desired position along center posts 54.

Finger brackets 57 rest on top of and are slidable upon center posts 54*c* and 54*d*. Finger brackets 57 may be lifted off of center post 54*c* and 54*d*. If an under water obstacle is encountered by propeller guard 45, gear box 58 and drive shaft housing pivot on wheel shaft 64, allowing propeller 44 to rise above the obstacle, minimizing damage to drive unit 50. Cable 72 is attached to hand lever 52 (FIG. 1) and controls forward and reverse propulsion.

Propeller guard 45, wheel shaft 64, and finger brackets 57 contribute to control of damage to the device. Each of such structures act as means for controlling damage. Any other damage control means that allows the propeller and/or drive unit to flex or be repositioned to lessen the force caused by an underwater object may be used.

Figure 6:
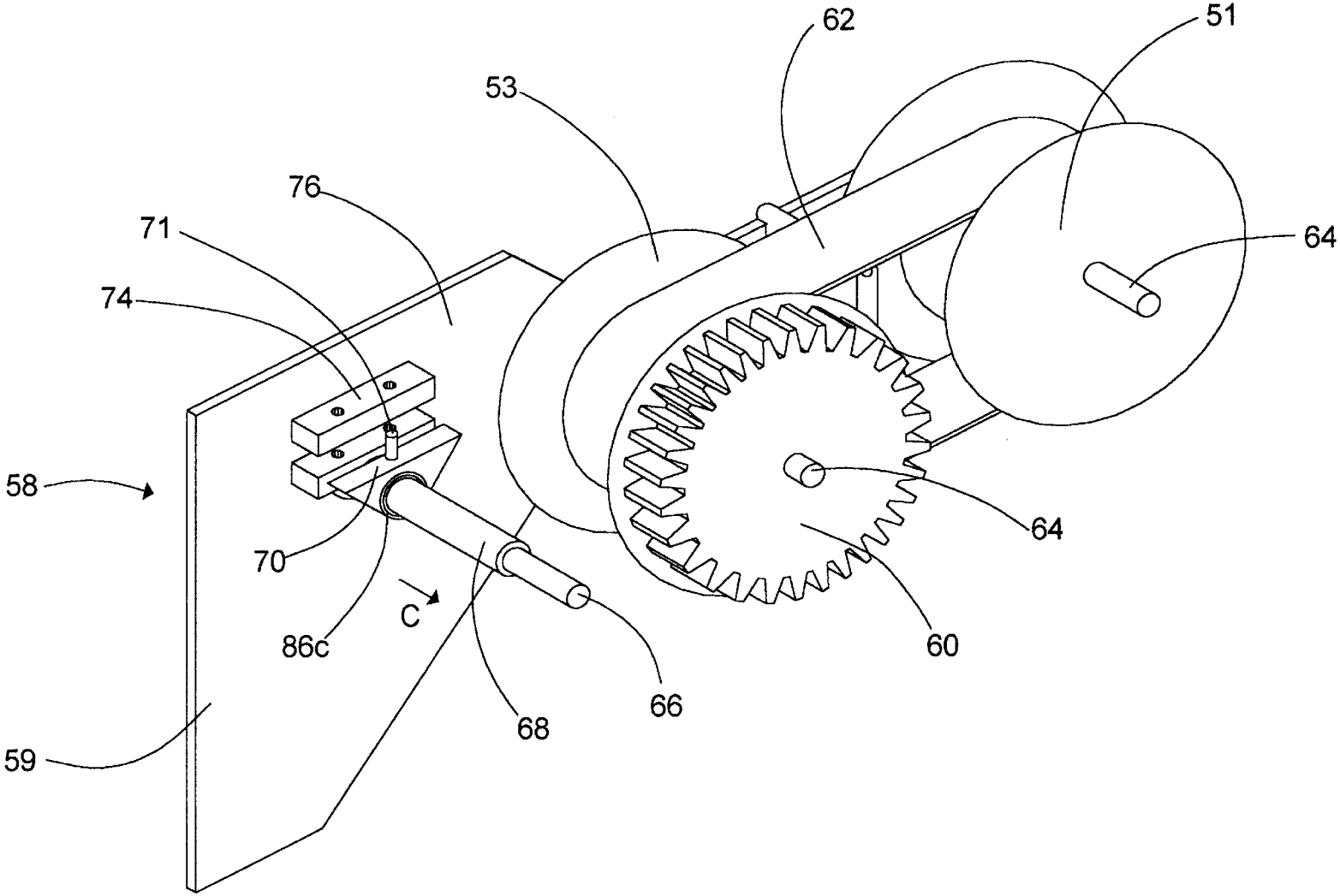
FIG. 6 is a perspective view of the partially disassembled drive unit illustrating the sliding shaft sleeve

FIG. 6 demonstrates the inner mechanism of the gear box 58. The rear wheel of the bicycle will rest on belt 62. Belt 62 is optional as the rear wheel of the bicycle could rest directly on wheels 51 and 53. Wheels 51 and 53 are flanged so the bike tire will not move laterally and fall off wheels 51 and 53 or belt 62. Gear 60 is attached to drive wheel 53 and transfers power to keyed shaft 66. Shaft 66 and sleeve 68 are keyed so they turn together. See FIG. 9. Sleeve 68 is free to slide back and forth on shaft 66. Pin assembly 70 is attached to sleeve 68 by bearing 86*c*. Such attachment allows pin 71 to stay in an upright position (see FIG. 6) while sleeve 68 and shaft 66 rotate below.

Figure 7:
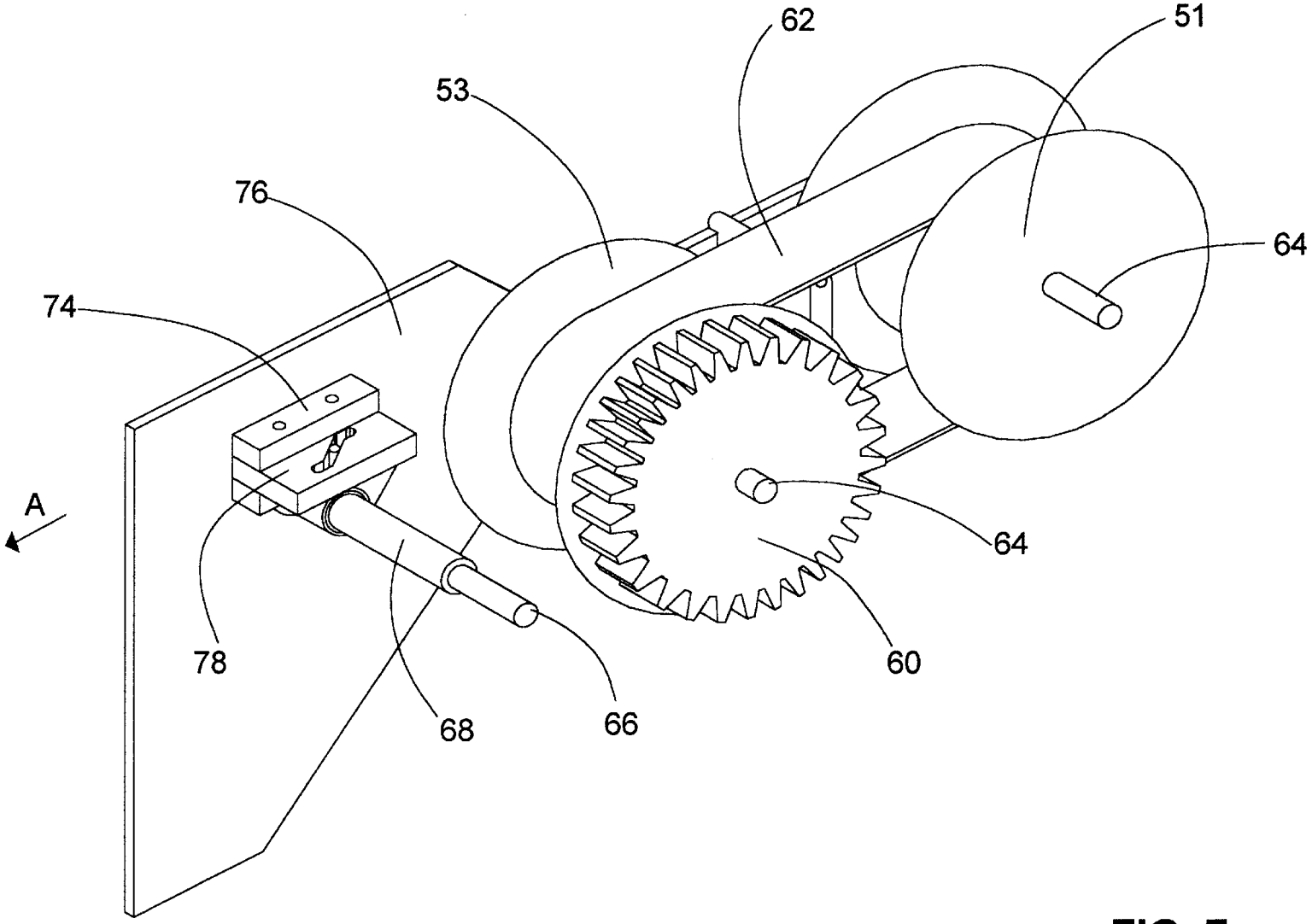
FIG. 7 is a perspective view of the partially disassembled drive unit illustrating the sliding shift mechanism.

FIG. 7 shows the inner mechanism of gear box 58 with slide 78. Slide 78 moves forward and back, but stays adjacent to lateral wall 76 of gear box 58. Pushing slide 78 in the direction of arrow A moves pin 70 and sleeve 68 toward lateral wall 76.

Figure 8:
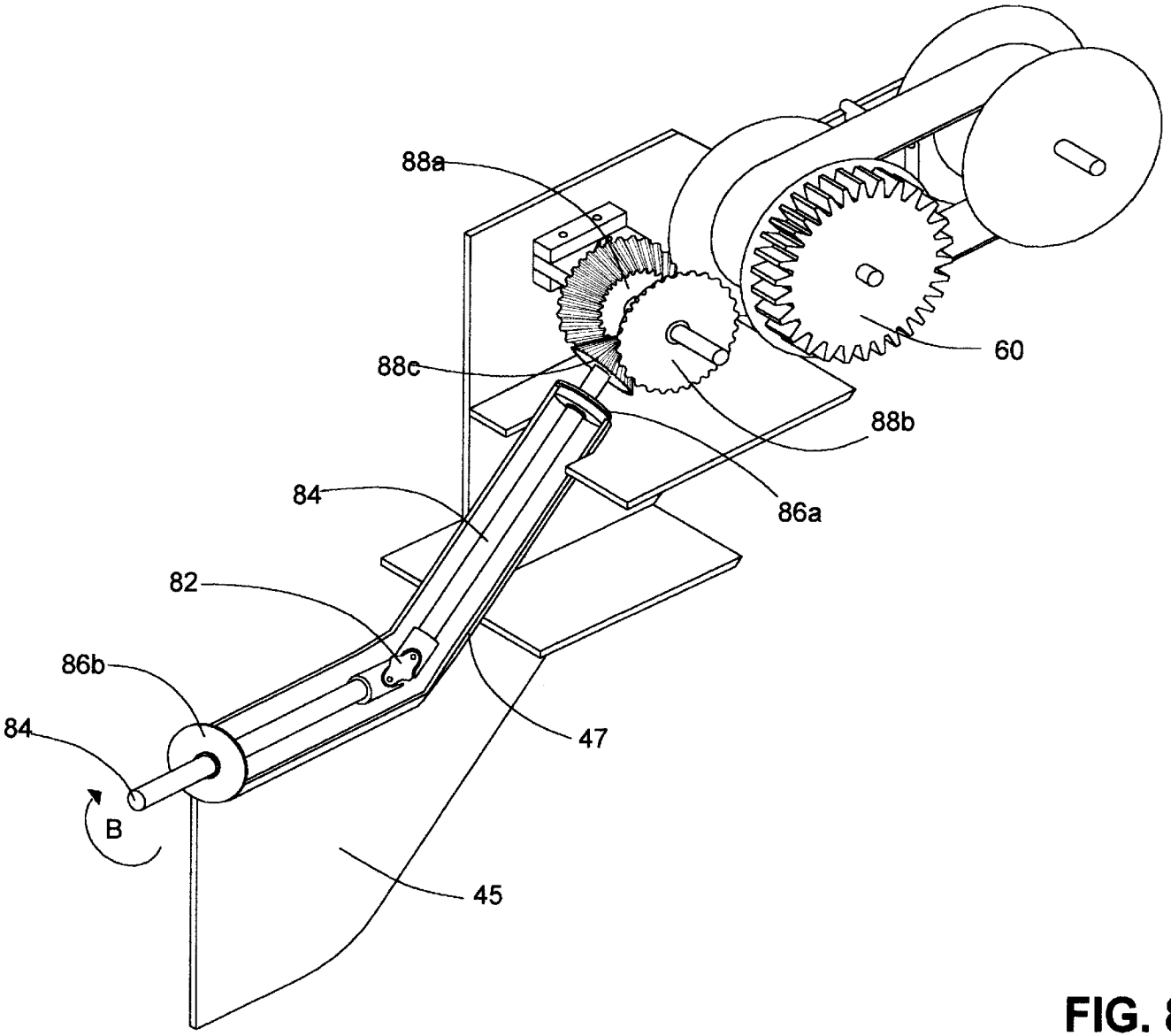
FIG. 8 is a perspective view of the partially assembled drive unit with cut away keyed shaft sleeve illustrating the drive shaft.

FIG. 8 is another view of the inner mechanism of gear box 58. Beveled gears 88*a–c* are used to translate force 90° to drive shaft 84. If slide 78 is in the forward position (in the opposite direction of arrow A shown in FIG. 7), gears 88*a* and 88*c* will engage, causing drive shaft 84 to rotate clockwise when viewed from the rear (the direction shown by arrow B, FIG. 8). When slide 78 is in the rearward position (direction arrow A), gears 88*b* and 88*c* engage, causing drive shaft 84 to rotate counterclockwise (opposite direction arrow B). Bearings 86*a–b* reduce friction on drive shaft 84. Universal joint 82 translates power to a horizontal plane for better efficiency.

Figure 9:
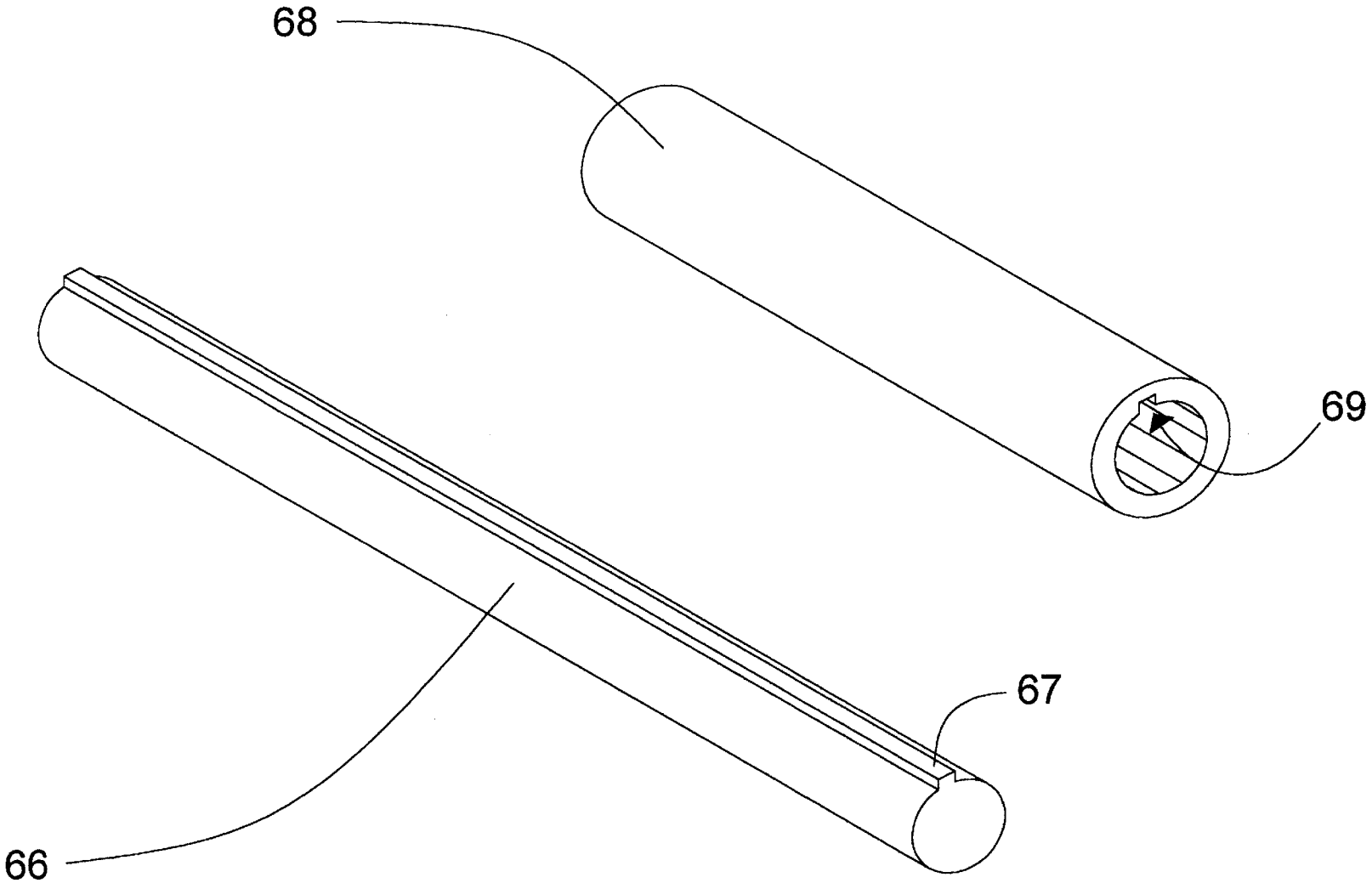
FIG. 9 is a perspective view of the keyed shaft and shaft sleeve.

FIG. 9 illustrates keyed shaft 66 and the shaft sleeve 68. Shaft 66 contains ridge 67 which is inserted into shaft sleeve 68 at groove 69. Ridge 67 causes shaft 66 to lock within sleeve 68 so that shaft 66 does not rotate within sleeve 68.

This design allows sleeve 68 to slide along shaft 66, while allowing both shaft 66 and sleeve 68 to rotate together.

Figure 10:
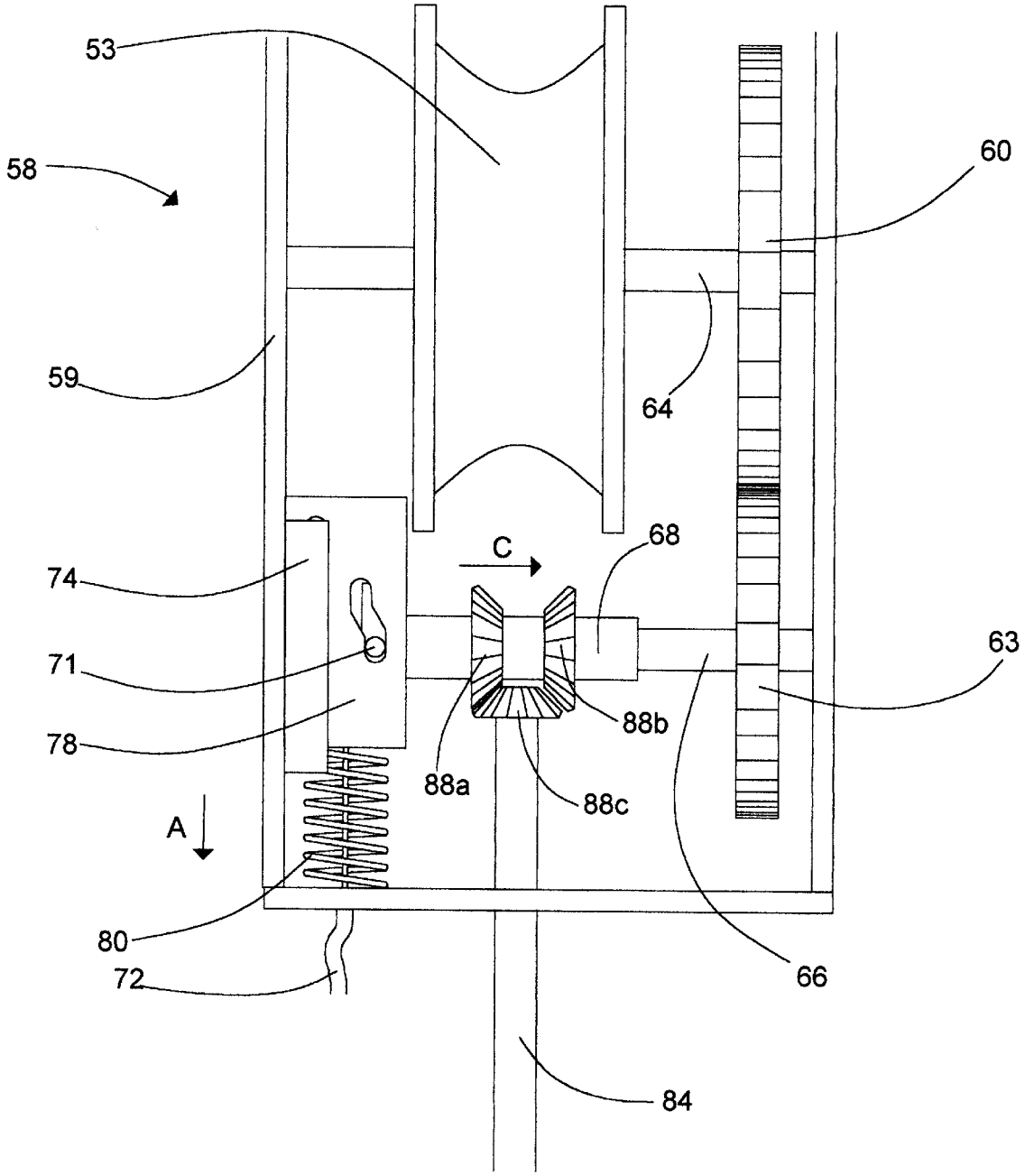
FIG. 10 is an illustration of the drive unit mechanism in forward gear.

FIG. 10 is a depiction of the inner components of gear box 58 in forward gear or forward position. The rear wheel of bicycle 20 engages wheel 53 to turn shaft 64 and gear 60. Gear 60 engages gear 63 turning shaft 66 and sleeve 68. With hand lever 52 at rest, there is no tension on cable 72 allowing spring 80 to push slide 78 into the forward propulsion position (opposite the direction of arrow A). With slide 78 in the forward position, pin assembly 70 (illustrated in FIG. 6), pin 71, shaft sleeve 68 and attached gears 88*a* and 88*b* are all moved to the right (direction of arrow C). Gear 88*a* and 88*c* are engaged, while gear 88*b* is disengaged. During operation while in the forward position, shaft 84 rotates clockwise (when viewed from the rear) leading to forward propulsion.

Figure 11:
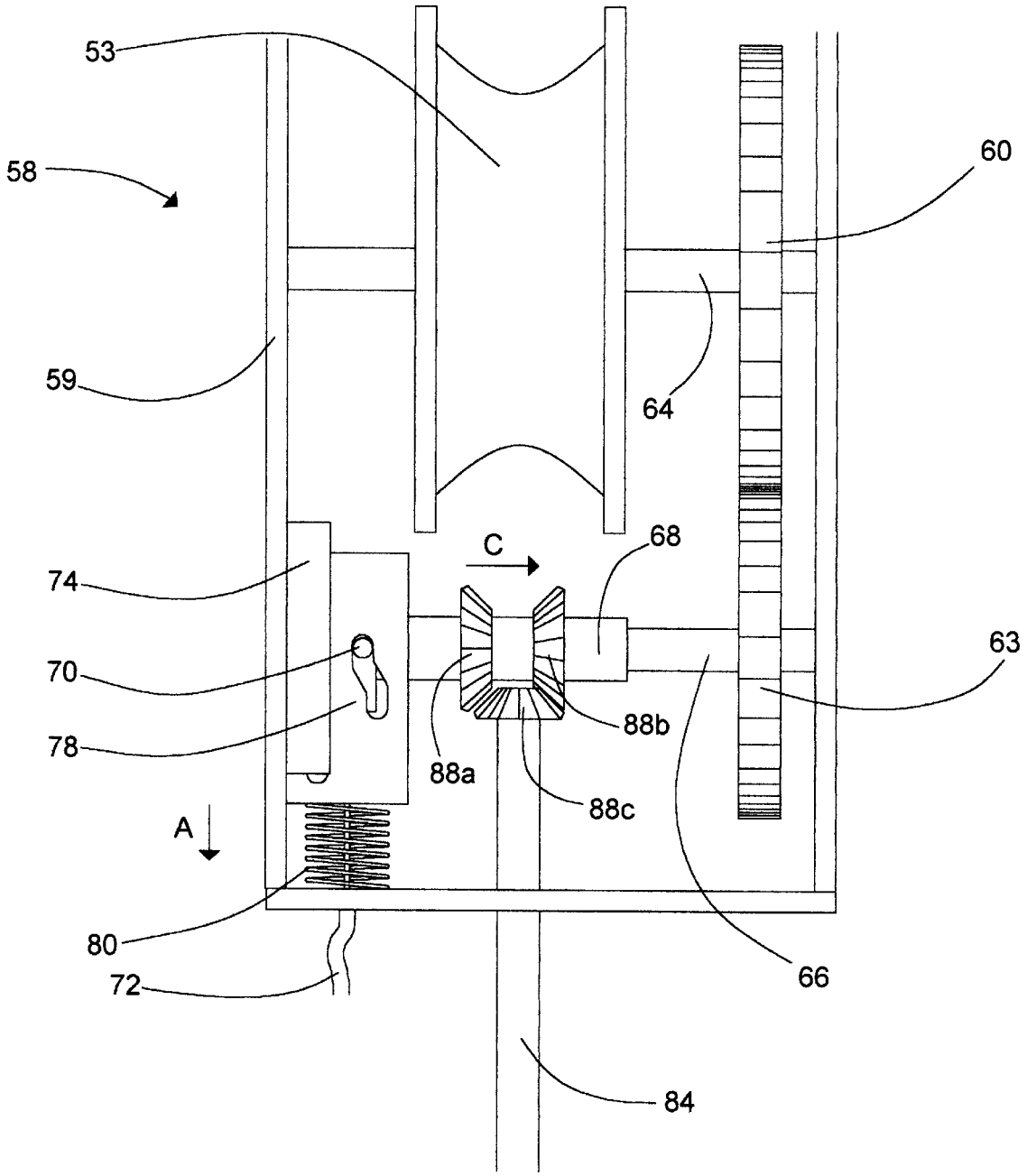
FIG. 11 is an illustration of the drive unit mechanism in reverse gear.

FIG. 11 is a depiction of the inner components of gear box 58 in reverse gear. When pressure is applied at hand lever 52, cable 72 is tightened compressing spring 80 and pulling slide 78 rearward (in direction of arrow A). This moves pin assembly 70, pin 71, sleeve 68 and gears 88*a* and 88*b* to the left (opposite the direction of arrow C). Gears 88*b* and 88*c* are engaged, while gear 88*a* is disengaged. Drive shaft 84 rotates counterclockwise, causing reverse propulsion.

Figure 12:
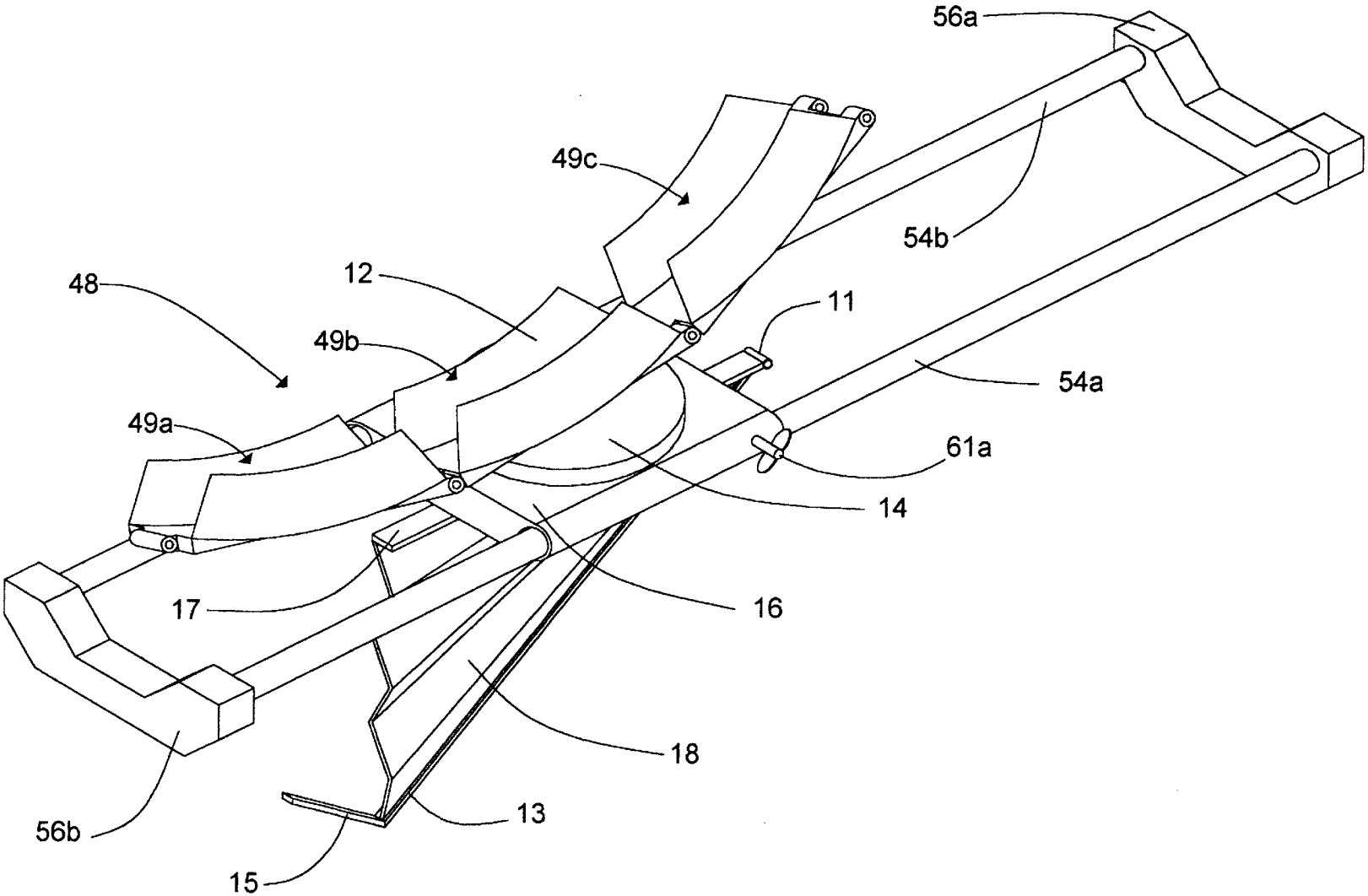
FIG. 12 is a perspective view of the steering unit.

FIG. 12 shows steering unit 48. The front bike tire rests in holder 12. Holder 12 has three hinged sections 49*a–c* allowing steering unit 48 to accommodate a variety of different tire sizes. Hinge sections 49 could also be spring loaded to better hold onto the tire. Holder 12 swivels on plate 14 to reduce friction and wear. Bracket 17 is attached directly to holder 12. Hinge 11 attaches to bracket 17 and rudder guard 13. Rudder guard hook 15 helps prevent rudder guard 13 from getting caught on obstacles especially when moving in the reverse direction. Rudder 18 is used to steer the device. Steering unit 48 includes protector means which includes rudder 18 formed like a folded fan. Protector means may further include rudder hinge 11 as described below. When rudder guard 13 (or 15) encounters an underwater obstacle there is an upward force on rudder guard 13, which closes hinge 11 causing rudder 18 to fold. This folding of rudder 18 helps minimize damage to steering unit 48 from underwater obstacles.

Steering unit 48 is supported by mounting bracket 16 which slides along center posts 54*a* and 54*b*. Steering unit 48 is connected to frame 38 of bike-boat 20 by connectors 56*a* and 56*b*. Steering unit 48 may be locked in place on the center posts 54*a* and 54*b* with thumbscrew 61*a*. Thumbscrew 61*a*, in conjunction with mounting bracket 16 sliding along center posts 54, operates as means for adjusting steering unit 48. Additional adjusting means may be used which may include notched center posts, push/pull buttons, pegs, or any other adjusting mechanism that allows the user to apply friction to secure rudder mounting plate 16 to a desired position along center posts 54.

Figure 14:
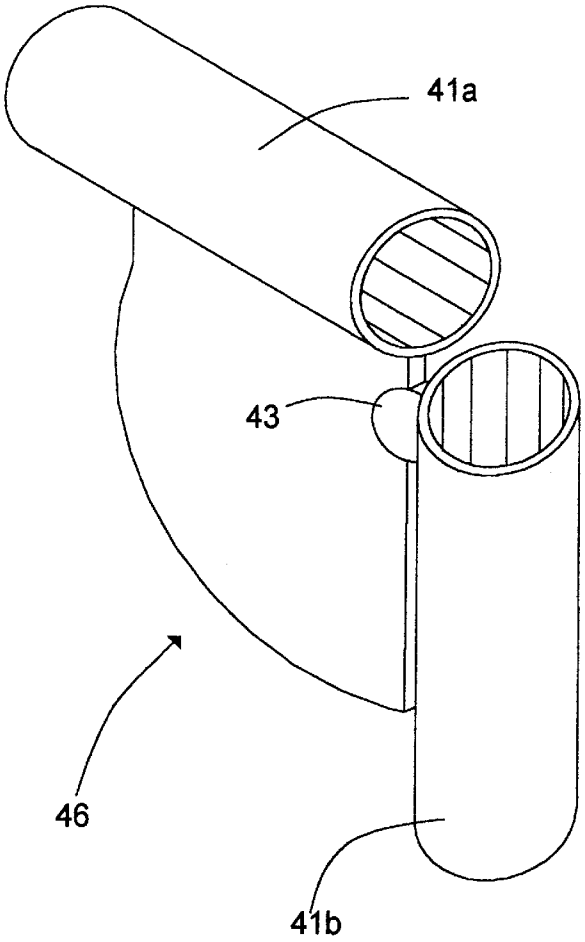
FIG. 14 is a perspective view of the hinge in a folded position.
Figure 13:
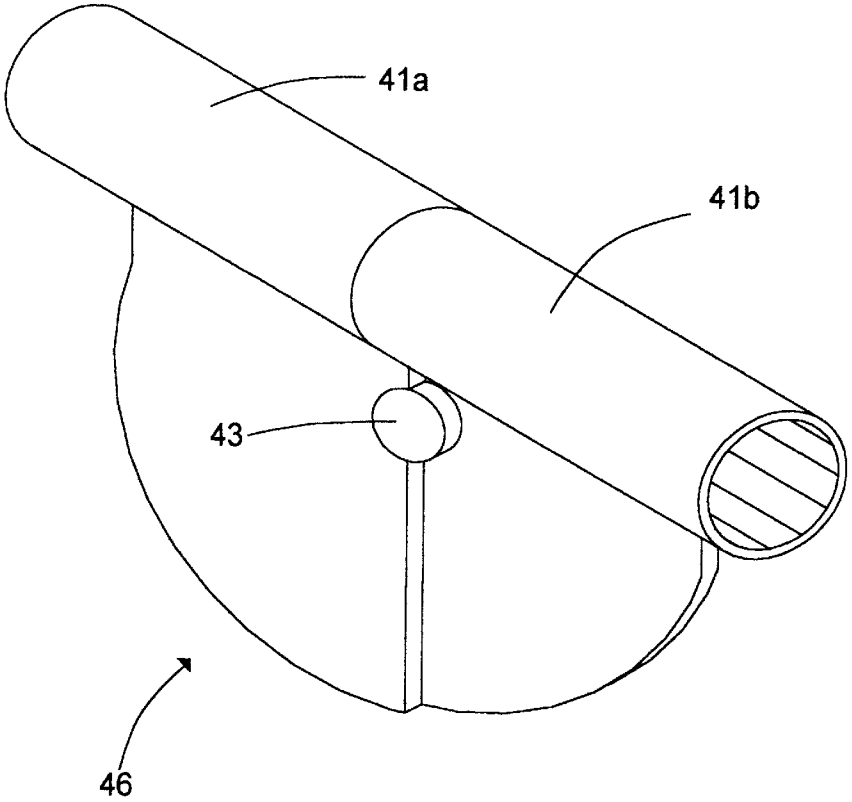
FIG. 13 is a perspective view of a hinge in an open position.

FIG. 13 and FIG. 14 illustrate hinges 46. Hinges 46 operate in a similar fashion to those on folding lawn furniture. Hinge 46 is non-locking and rotates from 0° to 90° at rivet 43. Sections 41*a–b* are sleeves that slide over metal tubular frame 38 and may be crimped in place.

Figure 15:
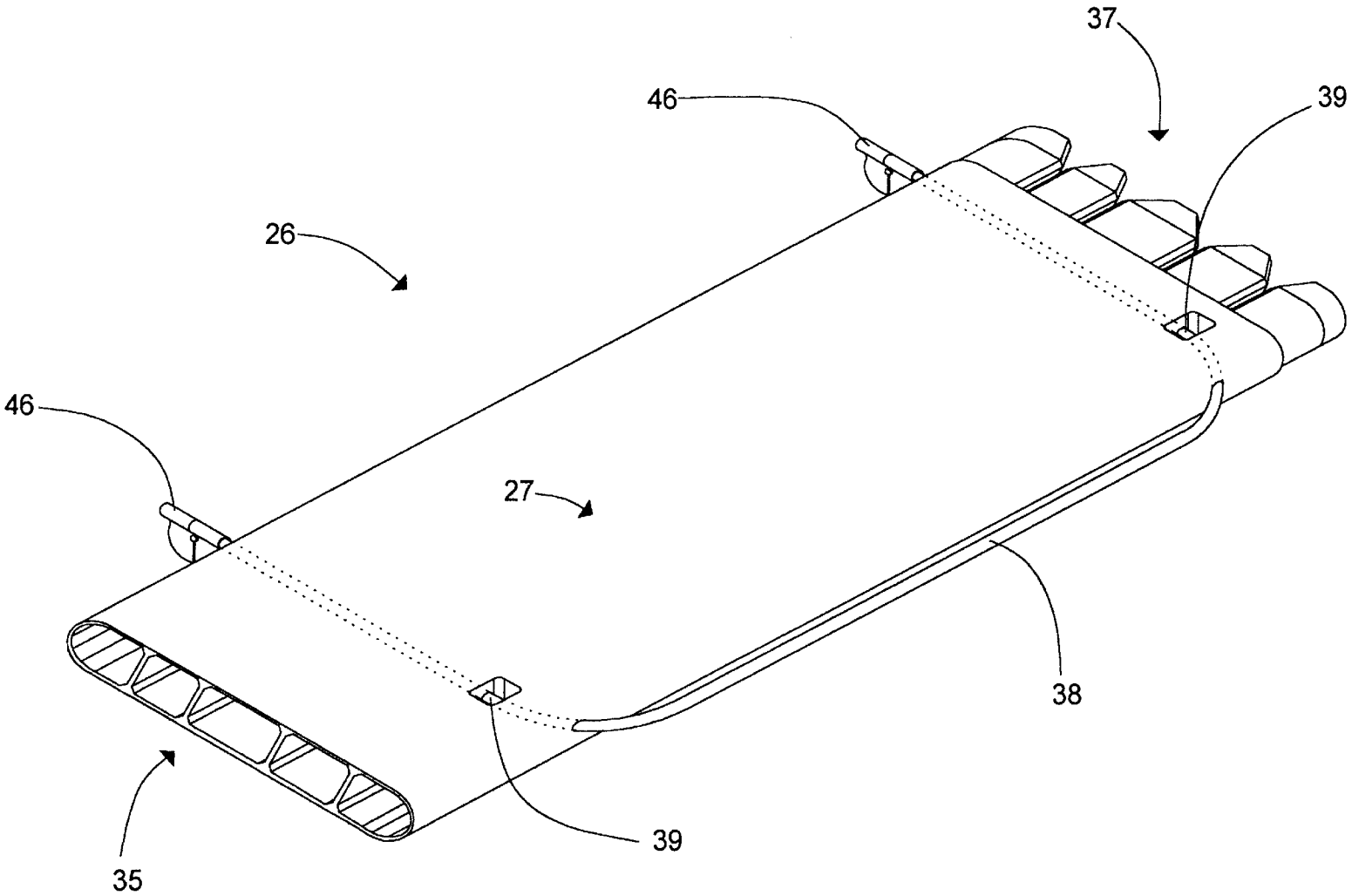
FIG. 15 is a perspective view of an alternative raft design.

FIG. 15 is an alternate design for bike-boat 20. The design illustrated up to this point incorporates tubes 36 to form the body of bike-boat 20. This alternate design incorporates a rigid plastic shell 27 rather than tubes 36. Shell 27 may be filled with a polymer foam such as Styrofoam which adds strength to shell 27 with minimal increase in weight. Tubular metal frame 38 is embedded in the shell 27. Shell 27 contains holes 39 which are attachment sites for the tie-down straps 42. Holes 39 expose embedded frame 38. Shell 27 comprises male connector 37 and female connectors 35 for attachment to other sections (not shown).

Figure 16:
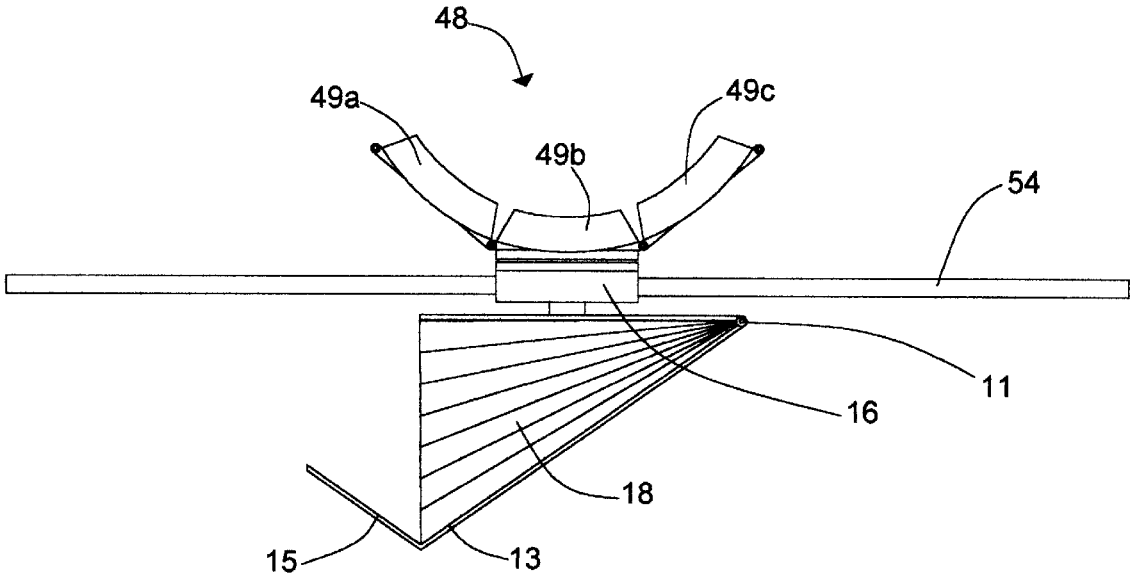
FIG. 16 is an illustration of the rudder assembly in a fully open position.
Figure 17:
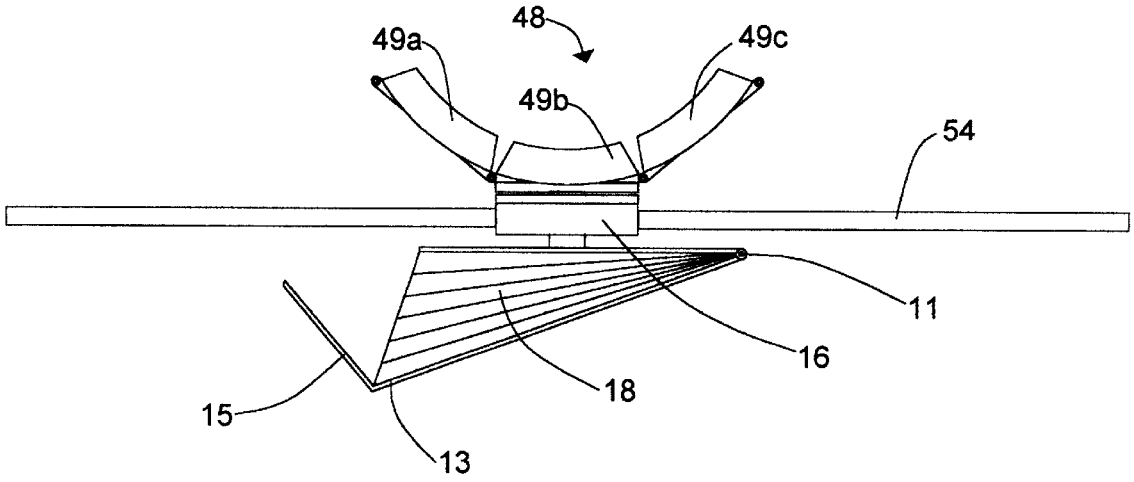
FIG. 17 is an illustration of the rudder assembly in a partially open position..

FIG. 16 and FIG. 17 illustrate how rudder 18 folds. FIG. 16 illustrates rudder 18 in the resting or open position. FIG. 17 illustrates rudder 18 partially closed, as might occur if rudder guard 13 or rudder guard hook 15 encounter an underwater obstacle.

Figure 18:
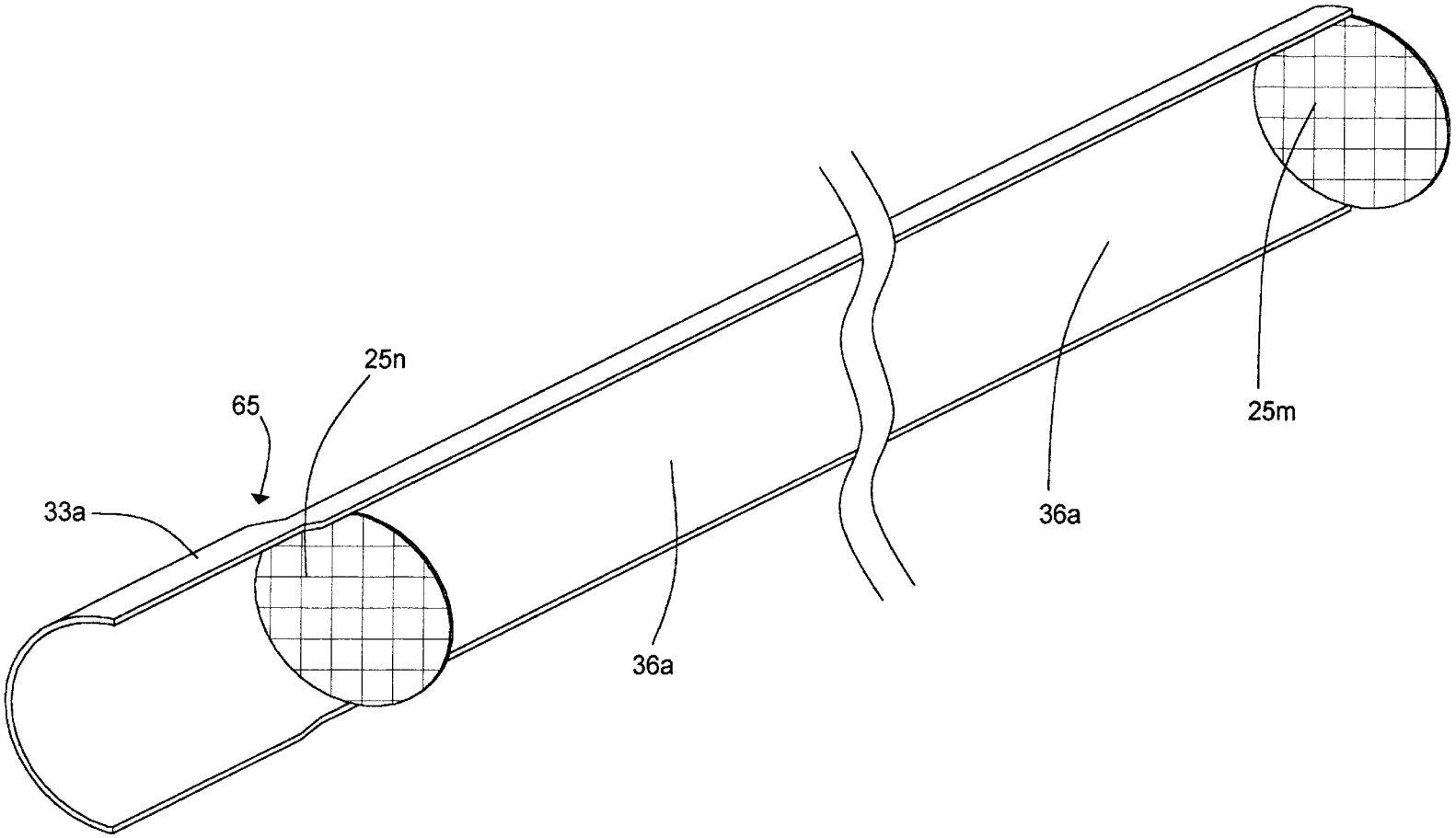
FIG. 18 demonstrates a cut away view of one of the floatation tubes used in the present invention.

FIG. 18 demonstrates a cut away section of one of the tubes 36 used in the present invention. A portion of tube 36*a* is cut away to expose for illustration the positioning of caps 25*m* and 25*n*. Flared end 33 originates at ridge 65. End cap 25*n* inserts into flared end 33 and slides down to abut ridge 65 where it is secured. End caps 25 form an air-tight compartment in tube 36 to provide buoyancy. All other tubes 36 have a similar placement of end caps 25. The tube illustrated in FIG. 18 corresponds to a tube used on front section 24, but it may also be used on rear section 30. Using a flared end 33 at the rear of the bike-boat makes it possible to plug together any number of individual bike-boats (front to back, forming a chain).

Another embodiment of the present invention includes the method of attaching a bicycle to a bicycle floatation and transportation device comprising the steps of providing a bicycle, providing a bicycle floatation and transportation device according to the structures and embodiment previously described, placing the bicycle upon said bicycle floatation and transportation device, and connecting the bicycle to the bicycle floatation and transportation device with a plurality of straps so that wherein a user may conveniently and quickly attach the bicycle to the floatation device without the use of tools and without modification of the bicycle.

A further embodiment of the present invention includes the method of transporting and storing a bicycle floatation and transportation device comprising the steps of providing a bicycle floatation and transportation device according to the structures and embodiment previously described, detaching the rear unit from the front unit, folding the front unit and folding the rear unit so that the folded front unit and the folded rear unit are convenient for transportation and storage.

Yet a further embodiment of the present invention includes the method of connecting multiple bicycle floatation and transportation devices comprising the steps of providing a first bicycle floatation and transportation device according to the structures and embodiments previously described, providing a second bicycle floatation and transportation device according to the structures and embodiments previously described, and connecting the second device to the first device so that multiple users may enjoy floatation and transportation.

While particular embodiments of the invention have been shown, it will be appreciated by those skilled in the art that modifications may be made without departing from the invention in its broader aspects, and that the scope of the invention should not be limited by what is seen. To the extent that variations and modifications to the invention do not depart from the spirit of the invention, they are intended to be included within the scope thereof which is assessed only by a fair interpretation of the claims.

I claim:

1. A bicycle floatation and transportation device comprising:

a floatable front unit having at least two front sections foldable about a single steering unit; and a floatable rear unit having at least two rear sections foldable about a single drive unit, said rear unit and said front unit detachably engaged, said drive unit spaced a distance from said steering unit to accommodate operation of said device with a single bicycle;

wherein a bicycle may be attached to said device so that a user may operate the bicycle to drive and steer said device through water.

2. The device of claim 1 wherein said front unit has at least two floating front sections hingedly connected to said steering unit.

3. The device of claim 2 wherein said floating front sections have an equal width.

4. The device of claim 2 wherein each of said two floating front sections has width greater than a width of said steering unit.

5. The device of claim 2 wherein each of said two floating front sections comprises a plurality of tubes.

6. The device of claim 5 wherein each of said plurality of tubes comprises a flared end.

7. The device of claim 2 wherein each of said two floating front sections comprises a shell.

8. The device of claim 1 wherein said device further comprises a plurality of straps for stabilizing the bicycle.

9. The device of claim 8 wherein said plurality of straps are connected to said device at corners of said device.

10. The device of claim 1 wherein said rear unit has at least two floating rear sections hingedly connected to said drive unit.

11. The device of claim 10 wherein said floating rear sections have an equal width.

12. The device of claim 10 wherein each of said two floating rear sections has width greater than a width of said drive unit.

13. The device of claim 10 wherein each of said two floating rear sections comprises a plurality of tubes.

14. The device of claim 10 wherein each of said two floating rear sections comprises a shell.

15. The device of claim 1 wherein said drive unit comprises adjusting means for adjusting said drive unit.

16. The device of claim 15 wherein said adjusting means comprises a sliding mounting bracket.

17. The device of claim 1 wherein said steering unit comprises adjusting means for adjusting said steering unit.

18. The device of claim 1 wherein said drive unit comprises damage control means for controlling damage to said drive unit.

19. The device of claim 18 wherein said damage control means comprises a wheel shaft upon which said drive unit pivots when struck by an underwater object.

20. The device of claim 1 wherein said steering unit comprises a rudder.

21. The device of claim 20 wherein said steering unit comprises protector means for protecting said rudder from damage.

22. The device of claim 21 wherein said protector means comprises a rudder hinge.

23. The device of claim 1 wherein said drive unit comprises at least two beveled gears for conveying rotational energy.

24. The device of claim 1 wherein said drive unit comprises propulsion means for forward and reverse propulsion of said device.

25. The device of claim 1 wherein said drive unit includes a slide for selectively alternating between a forward gear and a reverse gear.

26. The device of claim 1 wherein said device includes a remote hand lever for selectively alternating between a forward gear and a reverse gear.

27. A method of attaching a bicycle to a bicycle floatation and transportation device comprising the steps of:

providing a bicycle;

providing a bicycle floatation and transportation device comprising a floatable front unit having at least two front sections foldable about a single steering unit, and a floatable rear unit having at least two rear sections foldable about a single drive unit, said rear unit and said front unit detachably engaged, said drive unit spaced a distance from said steering unit to accommodate operation of said device with a single bicycle;

placing said bicycle upon said bicycle floatation and transportation device; and connecting said bicycle to said bicycle floatation and transportation device with a plurality of straps;

wherein a user may conveniently attach said bicycle to said floatation device without the use of tools and without modification of said bicycle.

28. A method for transporting and storing a bicycle floatation and transportation device comprising the steps of:

providing a bicycle floatation and transportation device comprising a floatable front unit having at least two front sections foldable about a single steering unit, and a floatable rear unit having at least two rear sections foldable about a single drive unit, said rear unit and said front unit detachably engaged, said drive unit spaced a distance from said steering unit to accommodate operation of said device with a single bicycle;

detaching said rear unit from said front unit;

folding said front unit and folding said rear unit;

wherein said folded front unit and said folded rear unit are convenient for transportation and storage.

29. A method for connecting multiple bicycle floatation and transportation devices comprising the steps of:

providing a first bicycle floatation and transportation device having a first plurality of tubes having flared ends, a floatable front unit having at least two front sections foldable about a steering unit, and a floatable rear unit having at least two rear sections foldable about a single drive unit, said rear unit and said front unit detachably engaged, said drive unit spaced a distance from said steering unit to accommodate operation of said first bicycle floatation and transportation device with a single bicycle;

providing a second bicycle floatation and transportation device having a second plurality of tubes; and connecting said second device to said first device by inserting said second plurality of tubes into said flared ends;

wherein said first and said second devices create a chain so that multiple users may join in floatation and transportation.

* * * * *